US006428000B1

(12) United States Patent
Hara et al.

(10) Patent No.: US 6,428,000 B1
(45) Date of Patent: Aug. 6, 2002

(54) SHEET TRAY OF IMAGE FORMING APPARATUS

(75) Inventors: Keisuke Hara, Takatsuki; Haruo Sayama, Yamatokoriyama, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/722,723

(22) Filed: Nov. 28, 2000

(30) Foreign Application Priority Data

Dec. 1, 1999 (JP) ..... 11-341654
Oct. 10, 2000 (JP) ..... 2000-308671

(51) Int. Cl.[7] ..... B65H 31/20
(52) U.S. Cl. ..... 271/223; 271/207; 271/213
(58) Field of Search ..... 271/171, 161, 271/145, 223, 213, 207, 175; 211/50; 400/625

(56) References Cited

U.S. PATENT DOCUMENTS 2,570,994 A * 10/1951 Vaughan et al. ..... 271/223
3,720,407 A * 3/1973 Woodward ..... 271/161
5,081,487 A * 1/1992 Hoyer et al. ..... 271/213
5,241,353 A * 8/1993 Maeshima et al. ..... 271/207

FOREIGN PATENT DOCUMENTS

JP 0052142 * 3/1983 ..... 271/223
JP 360040335 A * 3/1985 ..... 271/171
JP 403138259 A * 6/1991 ..... 271/223
JP 405278868 * 10/1993 ..... 271/171
JP 5-319635 A 12/1993

* cited by examiner

*Primary Examiner*—H. Grant Skaggs

(57) ABSTRACT

A foldable tray is angularly displaceably supported at an end portion of a sheet tray of a printer body so as to be angularly displaceable about a supporting shaft, which foldable tray is capable of being folded onto an upper surface side of the sheet tray and is angularly displaced downwardly from the sheet stacking position when a force which exceeds the maximum loading weight of sheets is applied to the foldable tray. Further, the sheet tray comprises a stopper for holding the foldable tray at a sheet stacking position and at a downwardly displaced position by abutting the foldable tray against the stopper.

9 Claims, 7 Drawing Sheets

SHEET TRAY OF IMAGE FORMING APPARATUS

BACKGROUND OF THE INVENTION

1. Field of the Invention

The present invention relates to a sheet tray of an image forming apparatus, and particularly to a sheet tray of an image forming apparatus which is disposed at a sheet feed part or sheet discharge part of the image forming apparatus and is provided with a second tray angularly displaceably supported at an end to a body of the sheet tray and foldable onto an upper surface side thereof.

2. Description of Related Art

Conventionally, as described in Japanese Unexamined Patent Publication JP-A 5-319635 (1993), there has been known a sheet feed tray having such a constitution that a second tray is attached to a sheet tray body angularly displaceably about a supporting shaft so as to be foldable onto an upper surface side thereof and when the second tray is angularly displaced, the second tray abuts against a portion of the sheet tray body which is outside the supporting shaft of the sheet tray body so that he second tray is stopped in the sheet stacking position.

The sheet feed tray is used in such a way that when the size of sheets to be stacked in the sheet feed tray is small, this sheet feed tray is used in the state that the second tray is folded on the upper surface side of the sheet tray body, while when the size of the sheets stacked in the tray is large, the sheet feed tray is used in the state that the second tray is unfolded.

In the sheet feed tray of the image forming apparatus having such a constitution, assuming that the sheet feed tray is used in the state that the second tray is unfolded, when a load which exceeds the maximum loading weight of the second tray is applied to the second tray, an excessive force is applied to the supporting shaft which angularly displaceably supports the second tray or to the sheet feed tray itself and hence, there arises a problem that a damage of this supporting shaft or sheet feed tray occurs.

SUMMARY

A sheet tray of an image forming apparatus of the invention has been made to solve the above-mentioned problem and it is an object of the invention to prevent a sheet tray or the like from being damaged by providing the sheet tray with a second tray supported on a body thereof so that the second tray is angularly displaceable in the downward direction from sheet stacking position when a load which exceeds a maximum loading weight is applied to the second tray.

To achieve the above-mentioned object, there is provided a sheet tray for an image forming apparatus, which is disposed at a sheet feed part or sheet discharge part of the image forming apparatus, the sheet tray comprising:

a body;

a second tray angularly displaceably supported on an end of the body of the sheet tray, the second tray being fordable onto an upper surface side of the sheet tray body, wherein the second tray is arranged to be angularly displaceable downwardly from a sheet stacking position when a force which exceeds a maximum loading weight of the second tray is applied to the sheet tray.

According to such a constitution, when the load which exceeds the maximum loading weight of the second tray is applied to the second tray, the second tray is angularly displaced downwardly whereby a supporting portion of the sheet tray which angularly displaceably supports the second tray can be prevented from being damaged.

In the invention it is preferable that the sheet tray comprises a stopper member for holding the second tray at a sheet stacking position and at a downwardly displaced position by abutting the second tray against the stopper member.

According to the invention, when the second tray which is held in the sheet stacking position by the stopper member is displaced downwardly upon receiving a force which exceeds a maximum loading weight of the second tray, the stopper holds the second tray at a downwardly displaced position, so that the second tray can be prevented from being angularly displaced excessively whereby the second tray can be surely prevented from being diamaged.

Further, in the invention it is preferable that a resiliency of the stopper member is set greater than that of the second tray.

According to the invention, when a load of a stack of sheets exceeding the maximum loading weight of the second tray is applied to the second tray, the stopper member is deformed by the weight applied to the second tray and hence, the second tray is displaced downwardly. Accordingly, the stack of sheets drop from the sheet tray, so that the sheet tray can be prevented from being damaged.

That is, when the second tray is displaced downwardly upon application of a force which exceeds the maximum loading weight to the second tray, the stopper member is deformed due to its own resiliency, which makes it possible to angularly displace the second tray downwardly. In this case, since the stopper member has a resiliency greater than that of the second tray, the second tray is not deformed and hence is angularly displaced while holding its flatness, so that the second tray can be prevented from being damaged.

Further, in the invention it is preferable that the stopper member is elastically deformed depending on a distance from the supported portion of the second tray on the end of the body of the sheet tray to the stopper member.

Accordingly, by merely changing the distance from the supported portion of the second tray to the stopper member, the maximum loading weight of the second tray can be varied. For example, when the distance from the supported portion of the second tray is made short, in angularly displacing the second tray downwardly from the sheet stacking position, unless the stopper member is deformed largely, the second tray cannot be displaced downwardly from the sheet stacking position. Accordingly, even when a large force is applied to the second tray, the second tray is held in the sheet stacking position and hence, the maximum loading weight can be increased.

Further, in the invention it is preferable that the stopper member is integrally formed with the sheet tray body and the thickness of the stopper member is made thinner than that of the sheet tray body.

In this manner, since the thickness of the stopper member is thinner than that of the sheet tray body, there is no possibility that due to the deformation of the stopper member generated at the time of angularly displacing the second tray, the force applied to the second tray will affect the sheet tray body. Accordingly, with such a simple constitution the sheet tray body can be prevented from being damaged. That is, the sheet tray body can maintain the flatness without being deflected and hence, the sheet tray body can be prevented from being damaged.

Further, in the invention it is preferable that a point where a supporting side end of the second tray abuts against the stopper in the sheet stacking position is set below a crossing point where a central line of the second tray and the stopper member cross perpendicular to each other and corresponds to the maximum loading weight.

Accordingly, when a load of a stack of sheets exceeding the maximum loading weight is applied to the second tray, the stopper member is deformed due to the load applied to the second tray and the second tray is displaced downwardly whereby the stack of sheets fall from the tray and it becomes possible to prevent excessive stacking of sheets whereby the tray can be prevented from being damaged.

Further, in the invention it is preferable that when the second tray is displaced downwardly from the sheet stacking position, the second tray abuts against an image forming apparatus body or a part attached to the image forming apparatus body so that angular displacement of the second tray can be restricted.

Due to such a constitution, since the angular displacement of the second tray is restricted by the image forming apparatus body or the part attached to the image forming apparatus body, it becomes possible to prevent the excessive angular displacement of the second tray so that the second tray can be prevented from being damaged.

Further, in the invention it is preferable that the stopper member is provided with a thin thickness portion to facilitate deformation of the stopper member.

According to the invention, when a load of a stack of sheets exceeding a predetermined load is applied to the second tray, the stopper member is surely deformed and the second tray is surely angularly displaced in the downward direction from the sheet stacking position.

In the invention it is preferable that the thin thickness portion of the stopper member is formed at a proximal end of and at a rear surface side of the sheet tray body where an end portion of the second tray abuts against the stopper member.

According to the invention the second tray can be surely held in the sheet stacking position and the second tray is surely angularly displaced from that position due to the excessive stacking of sheets.

With respect to the above-mentioned second tray, it is needless to say that when the excessive external force is applied to the second tray in the state that the second tray is held at the sheet holding position, the second tray is angularly displaced so that damages of the tray per se due to an excessive external force can be prevented and damages of the supported portion of the second tray can be also prevented.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
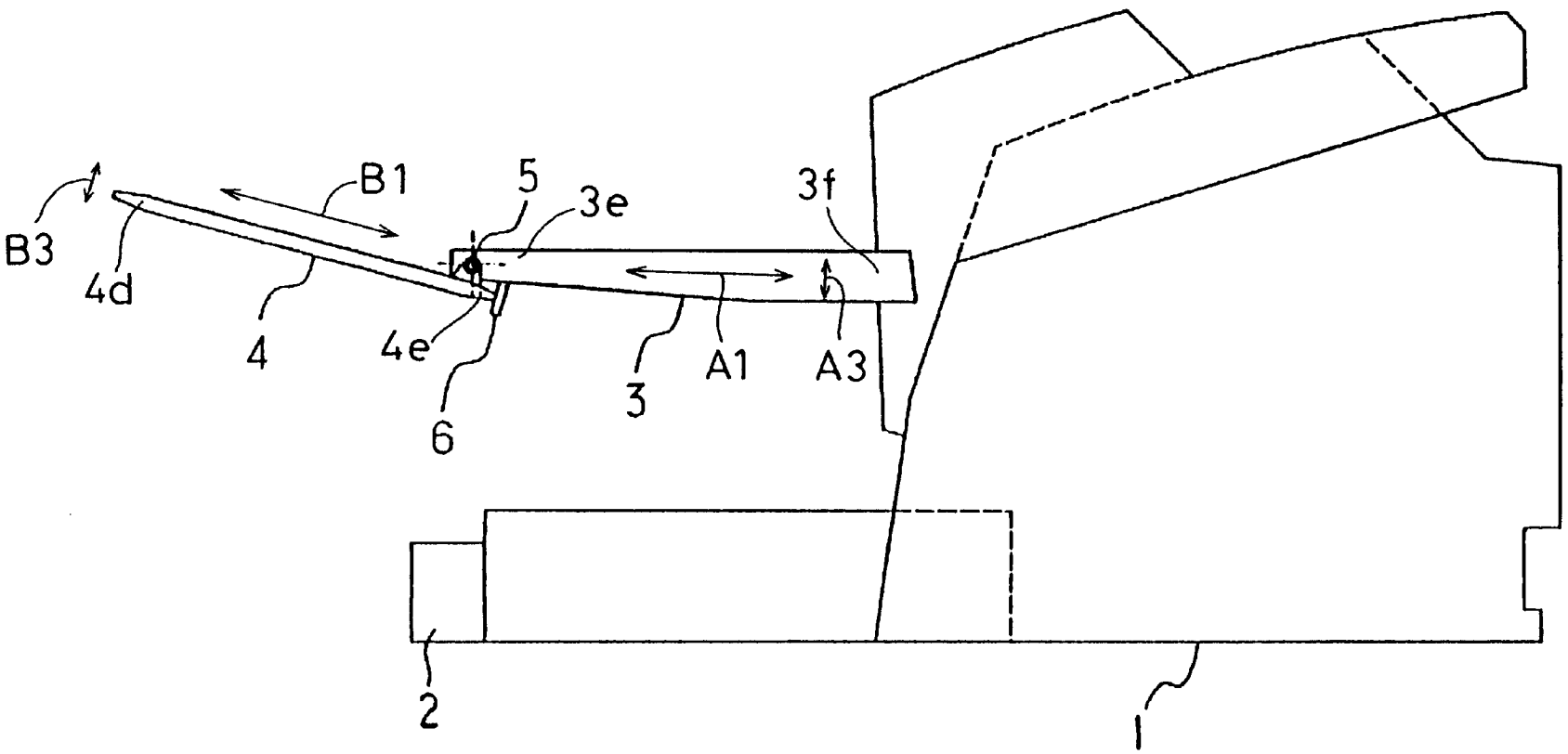
FIG. 1 is a schematic side view of an ink jet printer using a sheet tray for an image forming apparatus of the invention in the state that a foldable tray is positioned at a sheet stacking position.

Now referring to the drawings, preferred embodiments of the invention are described below.

An embodiment in which a sheet tray of an image forming apparatus of the invention is used as a sheet discharge tray of an ink jet printer is explained in conjunction with drawings.

(First Embodiment)

An example according to the first embodiment of the invention is explained in conjunction with FIG. 1 to FIG. 4.

In the ink jet printer according to this embodiment, a sheet feed cassette 2 is replaceably mounted on a lower portion of a front surface of a printer body 1, while a sheet discharge tray 3 which constitutes a sheet tray body onto which sheets being fed from the sheet feed cassette 2 and being formed with images in ink are discharged is mounted on an upper portion of the front surface of the printer body 1 and above the sheet feed cassette 2.

The sheet discharge tray 3 is formed of an approximately rectangular plate and one end 3*f* of the sheet discharge tray 3 on which a pair of side peripheral portions which oppose each other extend in the first direction A1 are connected to the printer body 1. Accordingly, the sheet is discharged from one end 3*f* of the sheet discharge tray 3 in the first direction A1 to the other end 3*e* of the sheet discharge tray 3 in the first direction A1. The other end 3*e* of the sheet discharge tray 3 in the first direction A1 constitutes a downstream side end in the sheet discharge direction.

A foldable tray 4 which constitutes a second tray is angularly displaceably supported to a downstream end portion of the discharge sheet tray 3 in the sheet discharging direction by means of supporting shafts 5. By angularly displacing the foldable tray 4 in the clockwise direction about the above-mentioned supporting shafts 5, the foldable tray 4 is folded onto an upper surface side of the discharge sheet tray 3 so that the state that the size (the length) of the whole tray becomes short can be obtained. Then, when the foldable tray 4 is angularly displaced in the counter clockwise direction from the state in which the foldable tray 4 is held in the folded state to the state in which the foldable tray 4 is positioned in the sheet stacking position (see FIG. 1), the size (the length) of the whole tray is increased so that the sheets having a large size can be discharged. Further, since the foldable tray 4 can be folded back, the size of the whole tray can be made compact.

The foldable tray 4 is formed in an approximately rectangular shape and one end portion 4*e* of the foldable tray 4 on which a pair of side peripheral portions which oppose each other extend in the first direction B1 are connected to the sheet discharge tray 3, one end 4*e* of the foldable tray 4 in the first direction B1 is supported to the other end 3*e* of the sheet discharge tray 3 in the first direction A1 so as to be angularly displaceable.

When the foldable tray 4 is developed from the folded state to the sheet stacking position or when the foldable tray 4 is folded back from the sheet stacking position to the folded state, the sheet discharge downstream side end of the foldable tray 4, that is, the other end 4*d* of the foldable tray 4 in the first direction B1 is angularly displaced about the supporting shafts 5 such that the other end 4*d* moves over the supporting shafts 5 which connect the other end 4*d* of the foldable tray 4 to the sheet discharge tray 3.

These supporting shafts 5 are formed on the sheet discharge tray 3 such that the supporting shafts 5 are mounted on inner sides of both side ends of the sheet discharge tray 3 and by inserting these supporting shafts 5 into insert holes (no shown in the drawing) formed in angularly displaceably supported portions of the foldable tray 4, the foldable tray 4 can be angularly displaceably mounted on the sheet discharge tray 3.

Further, a stopper 6 having following functions is integrally mounted on a rear surface of the sheet discharge tray. That is, when the foldable tray 4 is angularly displaced, an angularly displaceably supported side end 4*e* of the foldable tray 4 abuts against the stopper 6 so as to hold the tray 4 in the sheet stacking position. Further, when a load (a force) which exceeds the maximum downward loading weight is applied to the foldable tray 4, the foldable tray 4 is deformed so that the end portion 4*e* of the foldable tray 4 is moved upwardly and the foldable tray 4 is angularly displaced downwardly and abuts against the rear surface of the sheet feed tray 2 so as to hold the foldable tray 4 at the position shown in FIG. 2.

When a force which exceeds the maximum loading weight is applied to the foldable tray 4, the stopper 6 is pushed by means of the end portion 4*e* of the angularly displaceably supported side of the foldable tray 4 and hence, the stopper 6 is deflected toward one end portion side 3*f* in the direction A1 of the sheet discharge tray 3.

Here, the rear surface of the foldable tray 4 means a lower surface in the thickness direction B3 thereof and the rear surface of the sheet discharge tray 3 means a lower surface in the thickness direction A3 thereof.

The thickness of the stopper 6 is set greater than the thickness of the sheet discharge tray 3 and the resiliency of the stopper 6 is set greater than the resiliency of the foldable tray 4.

In other words, the elastic coefficient of the stopper 6 is set to a value smaller than that of the foldable tray 4.

Due to such a constitution, in the state shown in FIG. 1, when a load (a force) exceeding the maximum loading weight is applied downwardly to the foldable tray 4 from above, the foldable tray 4 is angularly displaced downwardly about the supporting shafts 5.

Figure 3:
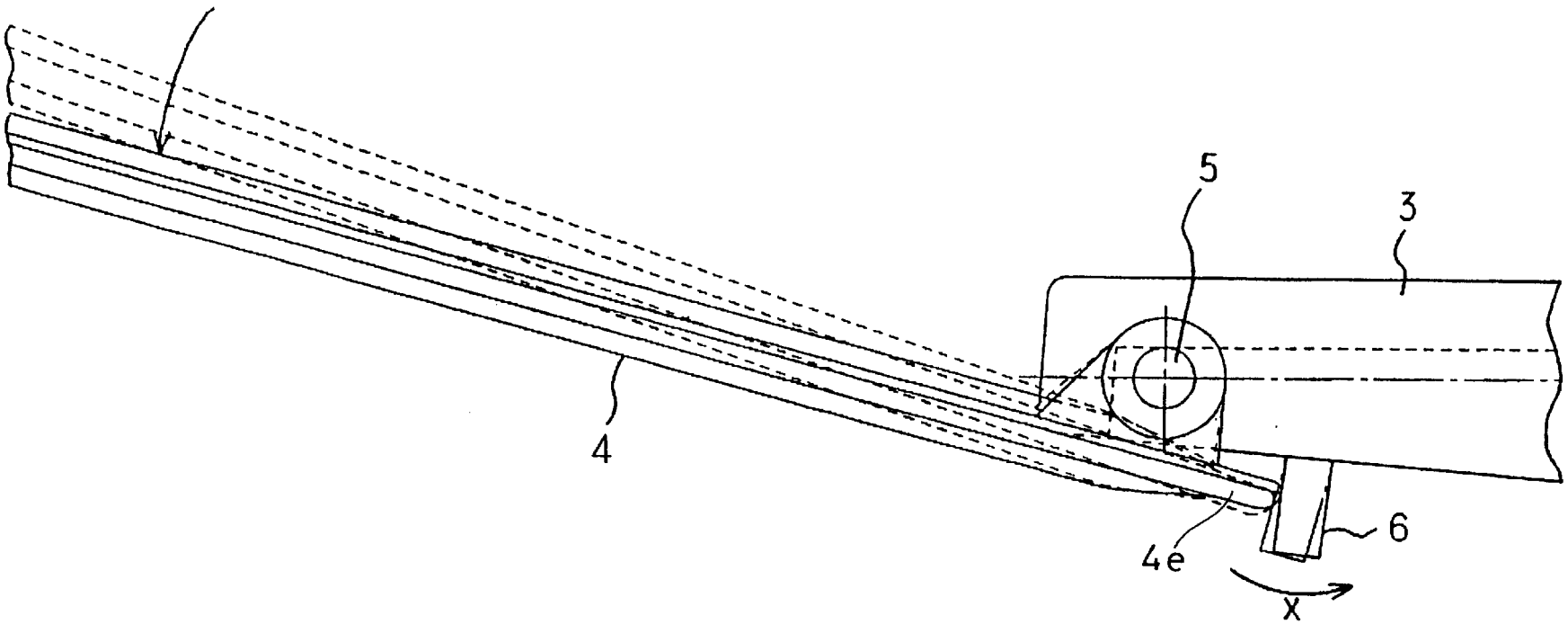
FIG. 3 is an explanatory view showing a deformation state of a stopper at the time of angularly displacing the foldable tray.

Here, as shown in FIG. 3, when the stopper 6 is pushed by the end portion of the foldable tray 4, the stopper 6 is deformed (deflected) from the state shown in a chained line to the state shown in a solid line in the direction of an arrow X so that the downward angular displacement of the foldable tray 4 becomes possible.

Here, the end portion of the foldable tray 4 constitutes the end portion 4*e* of the angularly displaceably supported side.

Accordingly, even when the load exceeding the maximum loading weight is applied to the foldable tray 4, there is no possibility that the excessive force is applied to the supporting shafts 5 and the foldable tray 4 so that the damage of the supporting shafts 5 and the foldable tray 4 can be prevented.

Further, the stopper 6 has a thickness thereof made thinner than the thickness of the sheet discharge tray 3 and has the resiliency greater than that of the foldable tray 4 and hence, the stopper 6 is deformed earlier than the deformation of the sheet discharge tray 3 and the foldable tray 4. Accordingly, there is no case that the sheet discharge tray 3 and the foldable tray 4 are deformed so that their flatness can be maintained. Furthermore, the damage of the sheet discharge tray 3 and the foldable tray 4 can be surely prevented.

Accordingly, until the weight of the stack of sheets exceeds the maximum loading weight, further stacking sheets on the foldable tray 4 can be allowed while maintaining the flatness thereby preventing the dropping of the sheets. When the weight of the stack of sheets exceeds the maximum loading weight, the restriction by the stopper 6 is released so that the foldable tray 4 is angularly displaced downwardly thus dropping the sheets thereon.

Figure 2:
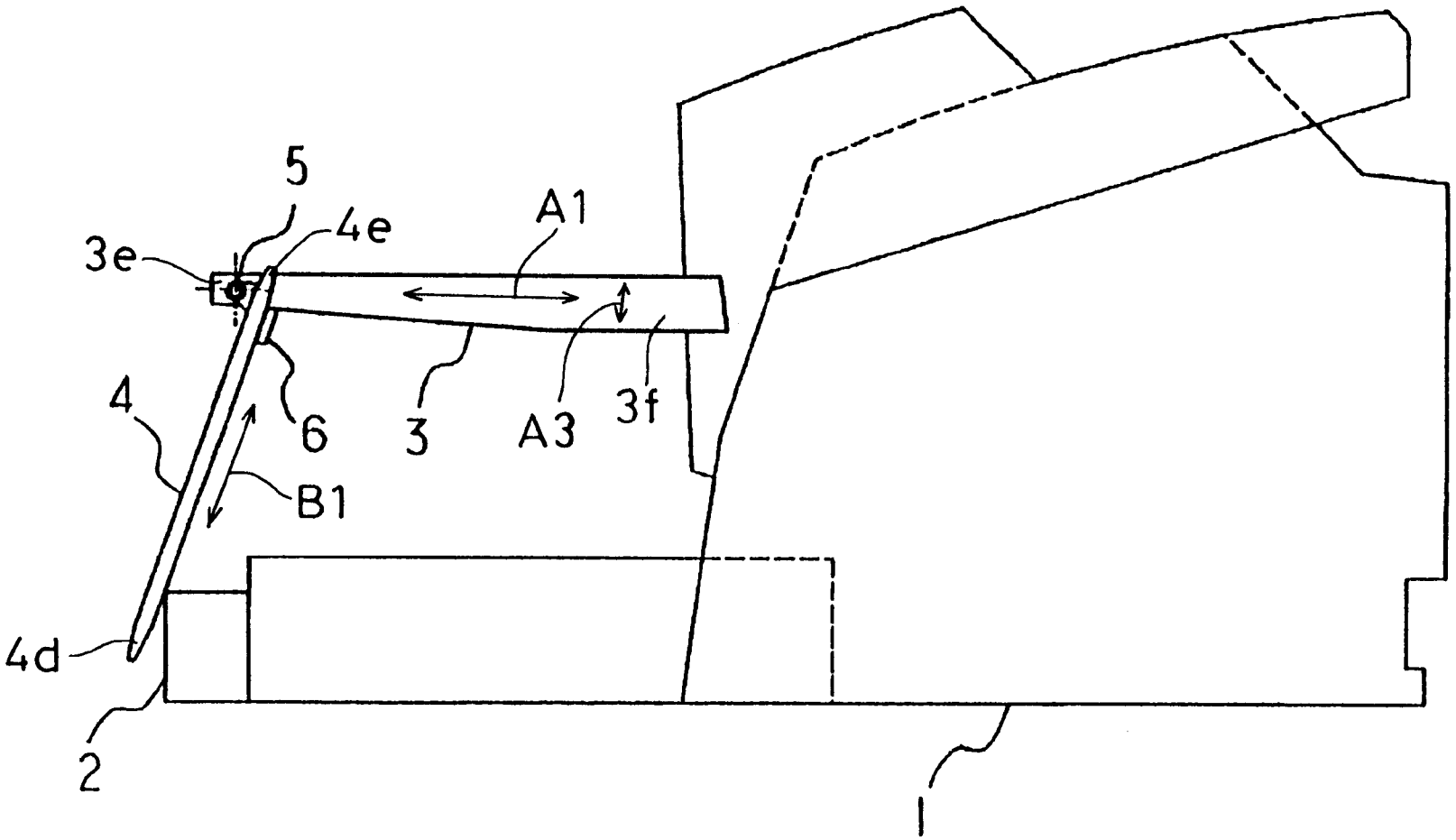
FIG. 2 is a schematic side view of an ink jet printer using a sheet tray for an image forming apparatus of the invention in the state that a foldable tray is downwardly angularly displaced.

Then, with respect to the downward movement of the foldable tray 4, when the foldable tray 4 is angularly displaced to a position shown in FIG. 2, the rear surface of the foldable tray 4 abuts against the stopper 6 and is also brought into contact with a distal end portion (an upstream side end portion in the sheet feeding direction) of the sheet feed cassette 2 of the printer body 1 so that the further angular displacement of the foldable tray 4 can be prevented.

Accordingly, the excessive angular displacement of the foldable tray can be prevented and hence, the damage of the angularly displaceably supported portion such as the supporting shaft 5 or the like can be prevented.

The foldable tray 4 which is angularly displaced downwardly can be returned to the sheet stacking position by being angularly displaced upwardly and can be held in this sheet stacking position.

Since the angular displacement of the foldable tray 4 about the supporting shafts 5 is restricted by abutting against both of the stopper 6 and the sheet feed cassette 2, an impact which is generated at the time of restricting the angular displacement can be dispersed at two points, that is, the stopper 6 and the sheet feed cassette 2. Further, a contact surface of the stopper 6 against which the foldable tray 4 abuts is formed in an inclined manner such that the contact surface is gradually extended in the frontward direction, that is, toward the downstream side in the sheet discharge direction as the contact surface advances downwardly. Since an imaginary line which extends along this inclined surface intersects the distal end portion of the sheet feed cassette 2, the foldable tray 4 abuts against the two points in the inclined state so that the foldable tray 4 is prevented from oscillating like a pendulum.

Figure 4:
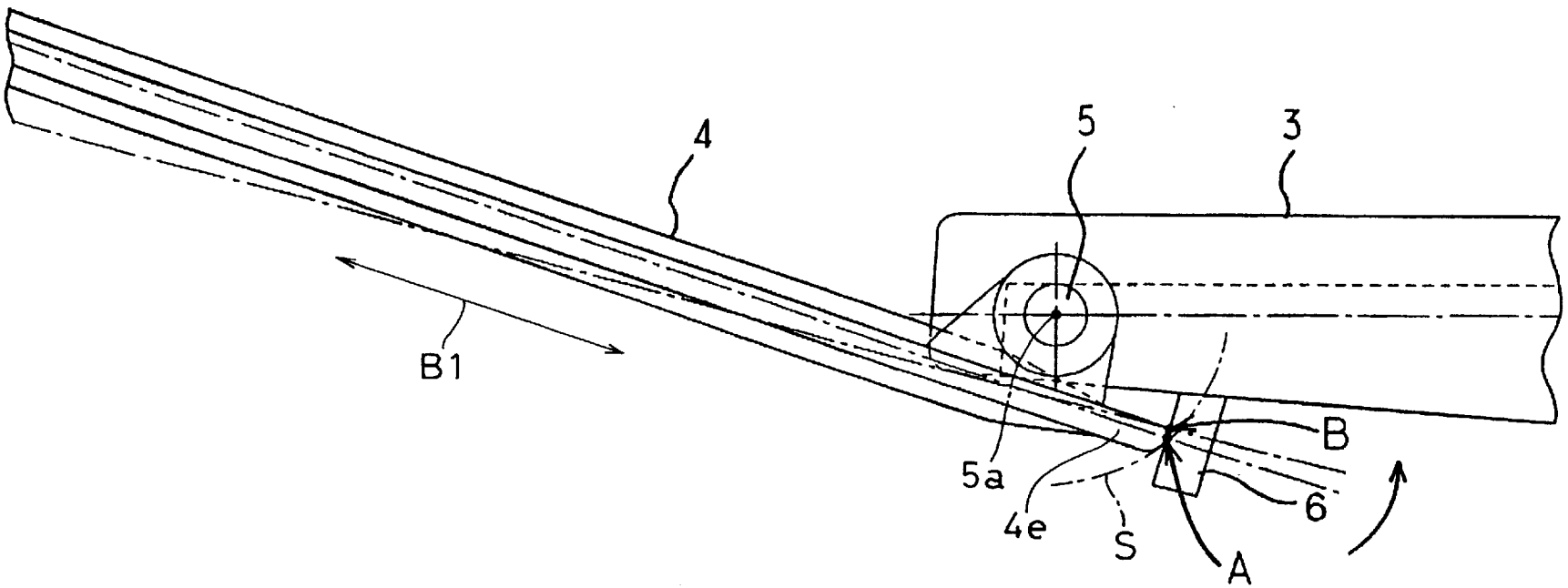
FIG. 4 is an explanatory view showing a contact point where the foldable tray of FIG. 1 abuts against the stopper.

Further, as shown in FIG. 4, a contact point A where an end portion of the foldable tray 4 at the supporting shafts 5 side and the stopper 6 abut against each other is set as a position which is disposed below a crossing point B where a center line of the foldable tray 4 and the contact surface of the stopper 6 cross or intersect perpendicular to each other and is set corresponding to the maximum loading weight of a stack of sheets.

That is, the contact point A is set such that following conditions are satisfied. Until the weight of the stack of sheets exceeds the maximum loading weight, the contact surface of the stopper 6 enters an inside region defined at the supporting shaft side of a locus S of the end portion 4*e* in the first direction B1 of the foldable tray 4 which is angularly displaceable about the supporting shafts 5 from above. When the weight of the stack of sheets exceeds the maximum loading weight, the contact surface is disposed in an outside region of the locus S.

To be more specific, in this embodiment, when a load of a stack of sheets equal to the maximum loading weight is applied to the foldable tray 4, a line which connects the contact position where the foldable tray 4 abuts against the stopper 6 and the supporting shafts 5 becomes perpendicular to the surface of the stopper 6 against which the foldable tray 4 abuts.

Such a setting is determined based on the relative positional relationship between the supporting shafts 5, the foldable tray 4 and the stopper 6, the shape of the stopper 6, the elastic coefficient of the foldable tray 4 and the stopper 6 and the like. Due to such a constitution, when a load of a stack of sheets exceeding the maximum loading weight is applied to the foldable tray 4, the restriction of the foldable tray 4 and the stopper 6 can be released with a simple provision without necessitating weight detection means such as a sensor.

Accordingly, when the sheets whose weight exceeds the maximum loading weight in total are discharged onto the foldable tray 4, the foldable tray 4 is angularly displaced downwardly due to the weight of the sheets and hence, the sheets fall downwardly. Accordingly, the damage of the foldable tray 4 and the angularly displaceably supported portion and the like can be prevented. Simultaneously, a jamming which may be caused when the rear ends of the discharged sheets on the sheet discharge tray 3 and the distal end of the sheet discharged from the printer body 1 bump into each other when sheets whose weight exceeds the maximum loading weight in total are discharged can be prevented.

Further, by changing the forming position of the stopper 6 from the supporting shaft 5, the allowable stacking number of the discharged sheets can be adjusted (changed). For example, when the distance of the stopper 6 from the supported portion of the foldable tray 4 is made short, to generate the downward angular displacement of the foldable tray 4 from the sheet stacking position, unless the stopper 6 is largely deformed, the foldable tray 4 cannot be angularly displaced downwardly from the sheet stacking position. Accordingly, even if a large force is applied to the foldable tray 4, the foldable tray 4 can maintain its sheet stacking position so that the allowable stacking number can be increased.

Although the explanation has been made with respect to the sheet discharge tray in the above-mentioned embodiment, a sheet tray having the constitution similar to that of the above-mentioned sheet discharge tray may be adopted as the sheet supply tray. Further, a sheet tray having the above-mentioned constitution may be adopted to a sheet feed tray for documents or a sheet discharge tray for documents.

That is, documents other than the sheets, for example, other sheet-like recording medium such as OHP sheets may be used. Further, this embodiment is not limited to the ink jet printer but also to other image forming apparatus such as a copying machine, a facsimile or the like.

(Specific Example of the Foldable Tray of the First Embodiment)

In the explanation of the example shown in FIG. 2 and FIG. 3, it has been explained that the foldable tray 4 is angularly displaceably mounted on the sheet discharge tray 3 by means of the supporting shafts 5. An example of such a angularly displaceable constitution is shown in perspective views of FIG. 5 and FIG. 6.

Figure 5:
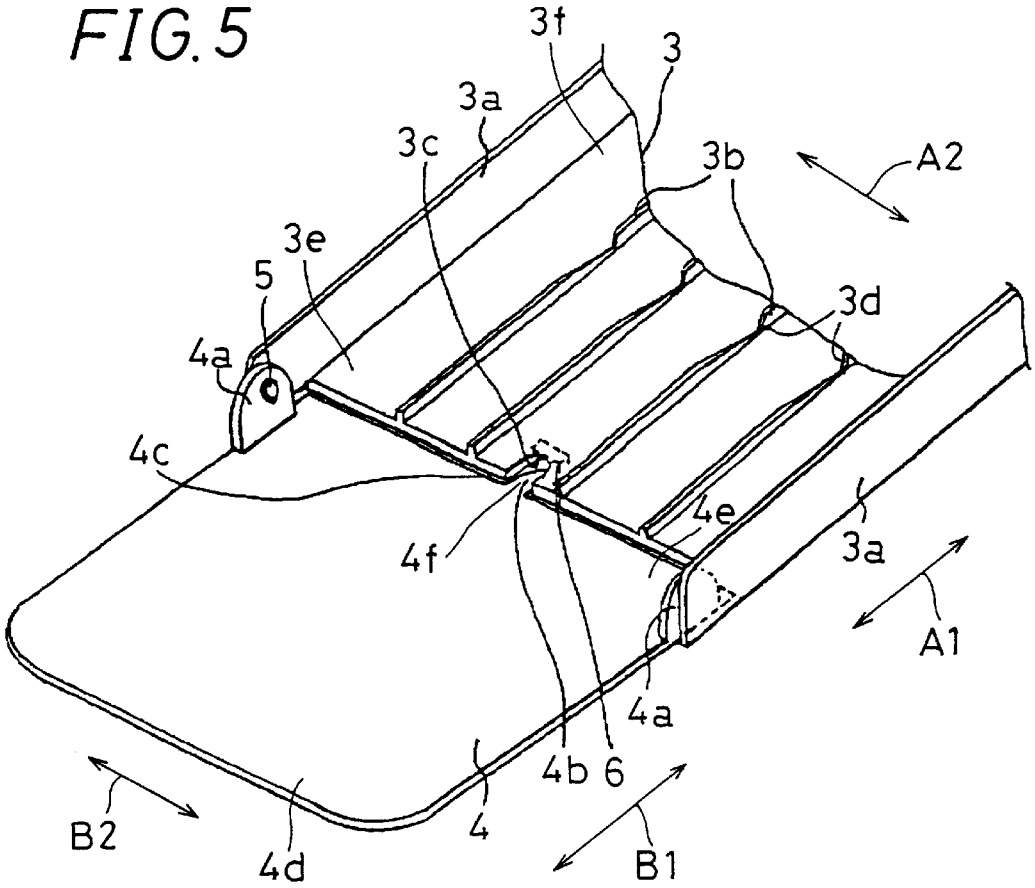
FIG. 5 is a perspective view showing one example of a sheet tray of the invention in the state that the foldable tray of FIG. 1 is held in a sheet stacking position.
Figure 6:
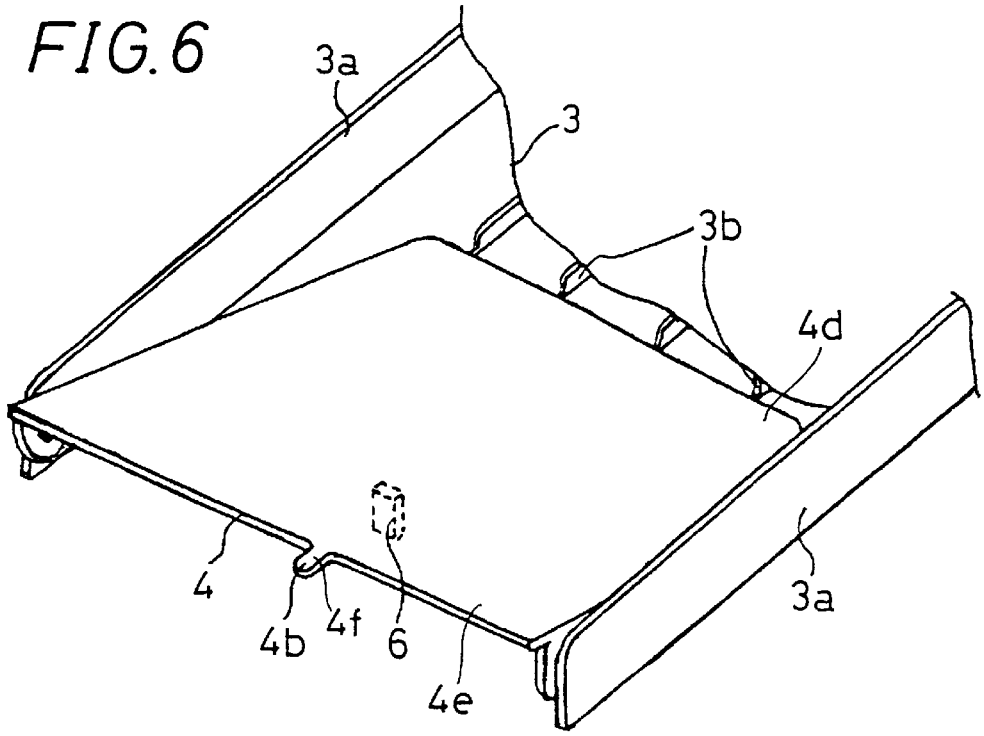
FIG. 6 is a perspective view of the sheet tray of FIG. 5 in the state that the foldable tray is folded on a sheet discharge tray of a sheet tray body from the sheet stacking position.

FIG. 5 shows the state that the foldable tray 4 is angularly displaced from the state that the foldable tray 4 is folded to the sheet discharge tray 3 constituting the sheet tray body to the sheet stacking position to receive sheets relative to the sheet discharge tray 3 as shown in FIG. 3 and is held in the sheet stacking position. FIG. 6 shows the state in which the foldable tray 4 is folded on the sheet discharge tray 3.

Regulating guides 3*a* which regulate and guide both side ends of the sheets or the like which are discharged are integrally formed with the sheet discharge tray such that the upper ends of the regulating guides 3*a* are bent. The supporting shafts 5 are integrally formed with the insides of both regulating guides 3*a* and are inserted into the insertion holes formed in the angularly displaceably supported portion 4*a* of the foldable tray 4. Due to such a constitution, the foldable tray 4 is angularly displaceable about the supporting shafts 5.

As shown in FIG. 5, The supporting shafts 5 are disposed at the other end portion 3*e* side of the sheet discharge tray 3 in the first direction A1 and are formed by being protruded toward the widthwise center of the sheet discharge tray 3 from restriction guides formed on both side end portions in the widthwise direction A2. Further, the angularly displaceably supported portions 4*a* of the foldable tray 4 are protruded in the thicknesswise direction B3 from one end 4*e* of the foldable tray 4 in the first direction B1, that is, toward the upper side in the sheet stacking position such that the angularly displaceably supported portions 4*a* are formed at both end portions in the widthwise direction B2 of the foldable tray 4. Further, insert holes are formed which penetrate these angularly displaceably supported portions in the widthwise direction B2.

The widthwise B2 size of the foldable tray 4 is set to a given, size in the widthwise direction which is smaller than the distance between the restriction guides 3*a* formed at both end portions in the widthwise direction of the sheet discharge tray 3. Accordingly, the foldable tray 4 is arranged such that the foldable tray 4 can be angularly displaceably folded back between the restriction guides 3*a*. Further, here, the widthwise direction A2 of the sheet discharge tray 3 is the extending direction of peripheral side portions which is perpendicular to the first direction A1 of the sheet discharge tray 3 and the widthwise direction B2 of the foldable tray 4 is the extending direction of peripheral side portions which is perpendicular to the first direction A1 of the foldable tray 4.

A plurality of guide ribs 3*b* which ensures the smooth discharge of the sheets to be discharged by decreasing a contact area with the sheet are formed on a sheet stacking surface of the sheet discharge tray 3 along the sheet discharge direction. Although the guide ribs 3*b* are formed on the sheet discharge tray 3, these guide ribs 3*b* may not be provided to the sheet discharge tray 3.

Accordingly, with respect to FIGS. 1 and 3, it is explained that the end portion of the foldable tray 4 at the angularly displaceably supported side abuts against the stopper 6 in the state that the foldable tray 4 is held in the sheet stacking position has been explained. FIG. 5 shows another case where the foldable tray is in a state different from such a state.

That is, a protruding end 4*b* is formed on the center of the end portion of the foldable tray 4 at the angularly displaceably supported point side. Corresponding to this protruding end 4*b,* a notch 3*c* is formed in a downstream side end portion of the sheet discharge tray 3 in the sheet discharge direction such that the foldable tray 4 can be angularly displaced from the state shown in FIG. 5 when the load of a stack of sheets applied to the discharge tray 3 exceeds the maximum loading weight (optimum loading weight). Corresponding to this notch 3*c,* to the above-mentioned foldable tray 4 side, the protruding end 4*b* which abuts against the stopper 6 which is integrally formed with the rear surface of the sheet discharge tray 3 and constitutes an end portion of the angularly displaceably supported side (an upstream-side end portion in the sheet in the sheet discharging direction) is provided.

Accordingly, the protruding end 4*b* is formed such that a protruding lug 4*f* which extends from the end portion 4*e* disposed at one side of the body of the foldable tray 4 in the first direction B1 and is further protruded toward one side of the foldable tray 4 in the first direction B1 is provided and the protruding end 4*b* is formed on one-side end portion of this protruding lug 4*f* in the first direction B1 of the foldable tray 4.

As mentioned above, the stopper 6 is formed on the rear surface of the sheet discharge tray 3 at the position corresponding to the notch 3*c* such that the stopper 6 is inclined as shown in FIG. 2, for example. When the protruding end 4*b* of the foldable tray 4 abuts against this stopper 6, the angular displacement posture of the foldable tray 4 is restricted to the state shown in FIG. 5 and hence, the sheet stacking position is held.

The above-mentioned inclination of the stopper 6 is formed such that the stopper 6 is directed toward the other end in the first direction A1 of the sheet discharge tray 3 as the inclination advances downwardly. By providing the stopper 6 to a portion of the sheet discharge tray 3 in the widthwise direction A2, the adjustment of the position of the sheet discharge tray 3 in the widthwise direction A2 of the sheet discharge tray 3 is facilitated compared to a case that the stopper 6 is provided to the whole surface of the sheet discharge tray 3.

Alternatively, in the case where the protruding end 4*b* is not provided in FIG. 5, the end portion 4*c* of the foldable tray 4 at the angularly displaceably supported side abuts against the stopper 6 provided at a position disposed at the most downstream end portion of the sheet discharge tray 3 in the sheet discharging direction and hence, the foldable tray 4 is maintained in the sheet stacking position.

Then, when the weight of the stack of sheets exceeds the maximum loading weight, the stopper 6 is deformed as shown in FIG. 3 and the foldable tray 4 is angularly displaced as shown in FIG. 2. At this point of time, the rear surface of the foldable tray 4 abuts against the stopper 6 so that the further angular displacement of the foldable tray 4 is restricted. Further, as shown in FIG. 2, the rear surface of the tray 4 abuts against the distal end portion of the sheet feed cassette 2 disposed below, the further angular displacement of the foldable tray 4 is restricted.

In FIG. 6, in the state that the foldable tray 4 is folded on the sheet discharge tray 3, the foldable tray 4 is folded such that the end portion of the foldable tray 4 (the end portion of the most downstream side in the sheet discharging direction) falls in the recessed portions 3*d* formed in the guide ribs 3*b* on the sheet discharge tray 3. This provision is also provided for preventing the distal end of the sheet from being engaged with the end portion of the sheet discharging tray 3 even in the state that the foldable tray 4 is folded. Accordingly, although the sheet to be discharged is initially discharged along with guide ribs 3*b,* the sheet is discharged while getting over the rear surface of the foldable tray 4 from the position of the recessed portions 3*d.*

Discharging of sheets is made possible even in the state that the foldable tray 4 is folded. However, particularly, in case that the discharging of the sheets is performed in the state that the foldable tray 4 is folded, when the weight of sheets stacked on the sheet discharge tray 3 exceeds the maximum loading weight (optimum loading weight), the succeeding discharged sheet is engaged with the preceding discharged sheet and hence, the discharge of such a sheet becomes impossible thereby giving rise to the failure of printing by an ink jet. To obviate such a failure, in the present invention, the foldable tray 4 is angularly displaced to the sheet stacking position in discharging sheets and when the load of sheets stacked on the discharge tray 3 exceeds the maximum loading weight, the foldable tray 4 is angularly displaced as shown in FIG. 2 thereby overcoming the drawback.

Accordingly, it becomes possible to make discharge of sheets impossible in the state that the foldable tray 4 is in the folded state as shown in FIG. 6. This can be realized by providing detection means and detecting the state that the foldable tray 6 is folded as shown in FIG. 6 with the detection means and inputting a detection signal to an image forming apparatus body, that is, an ink jet printing body. Due to such a provision, at the printing body side, it becomes possible to make the image forming (printing) operation in the state that the foldable tray 4 is folded inoperative.

The above-mentioned detection of folding can be realized by providing a detection sensor or the like to a position of the supporting shaft 5 or a position of the recessed portion 3*d* of the guide rib 3*b*.

(Second Embodiment)

With respect to the constitution of the above-mentioned first embodiment, particularly, with respect to the stopper 6 which is provided for angularly displacing and holding the foldable tray 4 in the sheet stacking position, it has been explained that the stopper 6 has the thickness thinner than that of the sheet discharge tray 3 so as to allow the displacement (the deformation) thereof when the maximum loading weight or the excessive load is applied to the foldable tray 4.

Figure 7A:
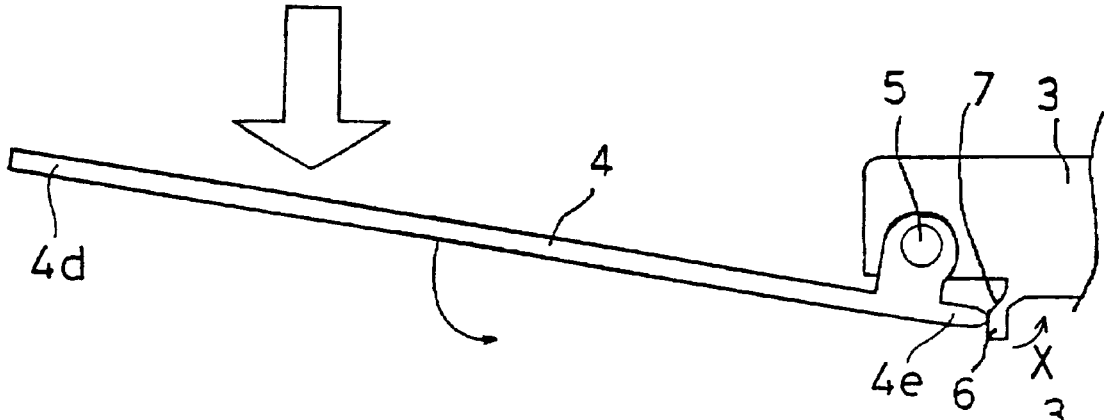
FIG. 7A and FIG. 7B are side views of a second embodiment of the invention in which a stopper member is improved, FIG. 7A showing the foldable tray which is held in the sheet stacking position and FIG. 7B showing the foldable tray angularly displaced downwardly from the sheet stacking position when an overload of sheets or excessive external force is applied to the foldable tray.
Figure 7B:
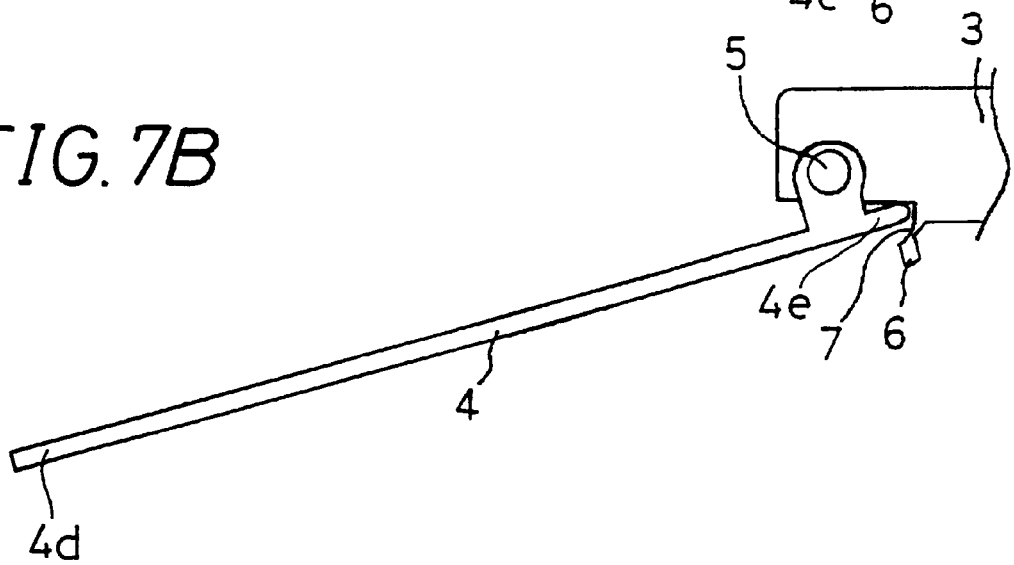

Further, in this embodiment, an example which gives rise to the effective deformation of the stopper 6 is explained hereinafter in conjunction with FIG. 7A and FIG. 7B.

Particularly, on a portion of the stopper 6, a recessed portion (a curved portion) 7 which constitutes a deformable thin thickness portion is formed. The curved portion 7 which constitutes a thin thickness portion is formed on a portion of the stopper 6 which faces the foldable tray 4 side in an opposed manner and a mounting end portion of a rear surface of the sheet discharge tray 3, that is, on a portion opposite to the end portion (the free end portion side) of the stopper, particularly a rear surface side of the sheet discharge tray 3. Particularly, the curved portion 7 is formed at the above-mentioned position other than a portion of the stopper 6 against which the angularly displaceably supported end portion of the foldable tray 4 abuts.

Due to such a constitution, when the sheets whose weight exceeds the maximum loading weight in total are discharged onto the foldable tray 4 or a large load due to an external factor, for example, an external force which exceeds the maximum loading. weight is applied to the foldable tray 4, the stopper 6 is pushed by an end portion (the protruding end 4*b* as shown in FIG. 5) which abuts against the stopper 6. Here, since the curved portion 7 is formed in the stopper 6, the stopper 6 is deformed in a direction of an arrow X shown in FIG. 7B. Due to such a constitution, the contact between the end portion of the foldable tray 4 and the stopper 6 is released and the foldable tray 4 is angularly displaced as shown in FIG. 7B. The restriction of this angular displacement is exactly identical with that of the first embodiment. That is, the restriction of this angular displacement is obtained in the state that the rear surface of the foldable tray 4 abuts against the stopper 6 or in the state that the rear surface of the foldable tray 4 abuts against the distal end of the sheet feed cassette 2.

When the large load is applied to the foldable tray 4 side in this manner, the foldable tray 4 is angularly displaced in the above-mentioned manner and hence, the jamming of the sheets to be discharged due to the excessive stacking of the sheets to be discharged or the damage of the supporting shaft 5, the foldable tray 4 or the like due to an external force can be prevented.

Although the curved portion 7 is formed to facilitate the deformation of the stopper 6, the position where the curved portion 7 is formed may be on the opposite side. That is, the curved portion 7 may be formed in the back surface side of the stopper 6 against which the end portion of the foldable tray 4 abuts. Particularly, the reason why the curved portion 7 is formed in the stopper 6 is that by providing a thin thickness portion at a portion of the stopper 6 thus facilitating the deformation of the stopper 6 whereby when the excessive amount loading or the external force is applied to the foldable tray 4, the foldable tray 4 is surely angularly displaced so that the effect for preventing the damage of the, supporting shaft 5, the foldable tray or the like and the jamming of the sheets can be enhanced.

Throughout the first and second embodiments, the overload means the state which is generated in a usual apparatus wherein strength calculations of respective parts are performed depending on the performance of the apparatus in designing the usual apparatus, when sheets are stacked on a sheet feeding portion whose number is greater than a predetermined number of sheets as a maximum loading capacity of the sheet feeding portion which is set at the initial designing (appropriate number of sheets). In this case, the mechanical designing considers the optimum, loading strength and the tolerance of an error at the time of assembling the apparatus. When the stacking of extra sheets corresponding to the tolerance of the error is performed, the excessive amount loading is generated. Alternatively, in the excessive amount loading at the sheet discharge part, the excessive amount loading is generated when the user continues the printing and the discharge of the sheets without collecting (removing) the printed sheets.

Accordingly, in the mechanical designing of the usual sheet feed part, as a safety factor of the loading strength, the safety factor of approximately 1.5 times or around 2 times of the sheets to be stacked is considered. Accordingly, in the sheet discharge part, when the user performs the continuous printing without collecting the printed sheets, it frequently gives rise to the above-mentioned problem (the problem which has been described in the paragraph of DESCRIPTION OF THE RELATED ART). In this respect, according to the present invention, in the case of overload of the sheet feed part or sheet discharge part, the foldable tray 4 is angularly displaced, whereby the problem related with the excessive loading can be overcome at the sheet feed part or sheet discharge part.

(Third Embodiment)

In this embodiment, a specific constitution which can change the forming position of the stopper 6 is explained hereinafter in conjunction with FIG. 8.

Figure 8:
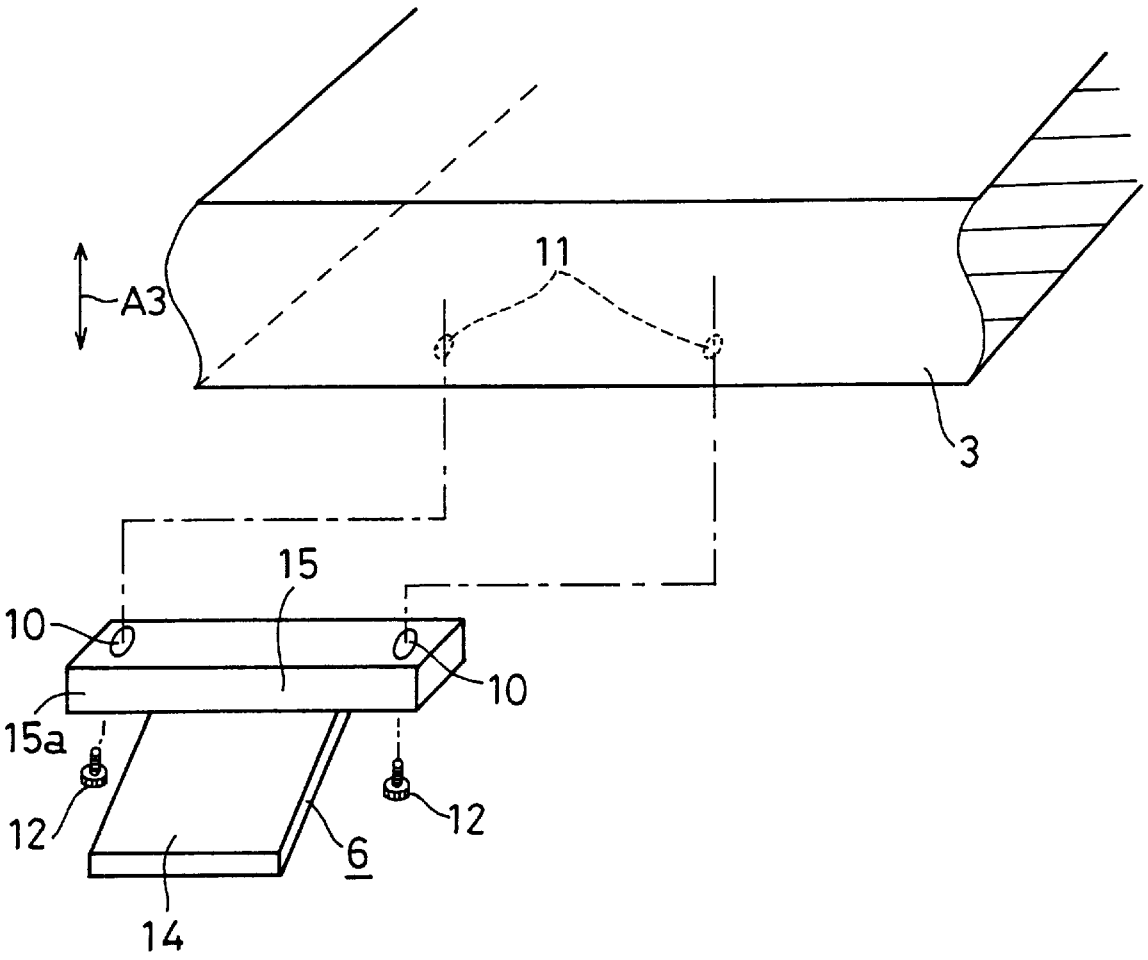
FIG. 8 is an exploded perspective view of a partial constitution of a third embodiment of the invention in which the stopper forming position is adjustable.

FIG. 8 is a perspective view showing a part of an image forming apparatus-in an exploded form wherein an example of the constitution which can adjust the forming position of the stopper 6 is shown. The stopper 6 includes a contact portion 14 having a contact surface against which a foldable tray 4 abuts and a connection portion 15 which is connected to a sheet discharge tray 3. The connection portion 15 is contiguously formed with one end portion of the contact portion 14 and includes protruding portions 15*a* protruding toward both sides of the contact portion 14 in the widthwise direction. Elongated holes are formed in these protruding portions 15*a* in the direction perpendicular to the contact surface of the contact portion 14 thus forming through holes 10 which penetrate the protruding portions.

Further, in the lower end portion of the sheet discharge tray 3. disposed at the other end side in the thicknesswise direction A3, connecting holes 11 having inner threads are formed for connecting the stopper 6. The connecting holes 11 are formed at a position where the stopper 6 is to be mounted, that is, at the other end portion side of the sheet feed tray 3 in the first direction A1 and on the lower surface of the sheet feed tray 3. That is, the connecting holes 11 are formed at positions corresponding to the through holes 10 of the stopper 6.

By inserting the inner screws having outer threads into the through holes 10 from below and threadedly engaging the inner screws into the connecting holes 11 formed in the sheet discharge tray 3, the stopper 6 can be connected to the sheet discharge tray 3. Here, since the through holes 10 are formed with a play relative to the thread members, it becomes possible to connect the stopper 6 to the sheet feed tray 3 by adjusting the forming position of the stopper 6. For example, the through holes 10 may be formed at two positions, for example. In this case, the angular displacement of the stopper 6 can be suppressed.

In this manner, by adjusting the forming position of the stopper 6, the distance between the stopper 6 and the supporting shaft 5 can be changed and hence, the maximum load of sheets to be discharged can be easily adjusted.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet tray for an image forming apparatus, which is disposed at a sheet feed part or sheet discharge part of the image forming apparatus, the sheet tray comprising:

a body;

a second tray angularly displaceably supported on an end of the body of the sheet tray, the second tray being foldable onto an upper surface side of the sheet tray body, wherein the second tray is arranged to be angularly displaceable downwardly from a sheet stacking position when a force which exceeds a maximum loading weight of the second tray is applied to the sheet tray.

2. The sheet tray of claim 1, comprising:

a stopper member for holding the second tray at a sheet stacking position and at a downwardly displaced position by abutting the second tray against the stopper member.

3. The sheet tray of claim 2, wherein a resiliency of the stopper member is set greater than that of the second tray.

4. The sheet tray of claim 2, wherein the stopper member is elastically deformed depending on a distance from the supported portion of the second tray on the end of the body of the sheet tray to the stopper member.

5. The sheet tray of claim 2, wherein the stopper member is integrally formed with the sheet tray body and a thickness of the stopper member is made thinner than that of the sheet tray body.

6. The sheet tray of claim 2, wherein a point where a supporting side end of the second tray abuts against the stopper in the sheet stacking position is set below a crossing point where a central line of the second tray and the stopper member cross perpendicular to each other and corresponds to the maximum loading weight.

7. The sheet tray of claim 2, wherein the stopper member is provided with a thin thickness portion to facilitate deformation of the stopper member.

8. The sheet tray of claim 7, wherein the thin thickness portion of the stopper member is formed at a proximal end of and at a rear surface side of the sheet tray body where an end portion of the second tray abuts against the stopper member.

9. The sheet tray of claim 1, wherein when the second tray is displaced downwardly from the sheet stacking position, the second tray abuts against an image forming apparatus body or a part attached to the image forming apparatus body so that angular displacement of the second tray can be restricted.

* * * * *